US006309306B1

(12) United States Patent
Geagley et al.

(10) Patent No.: US 6,309,306 B1
(45) Date of Patent: Oct. 30, 2001

(54) INTERACTIVE ENTERTAINMENT ATTRACTION USING TELEPRESENCE VEHICLES

(75) Inventors: Bradley K. Geagley, Los Angeles; Joseph O. Garlington, LaCrescenta; John T. Hagen-Brenner, Van Nuys, all of CA (US); Gary J. Nadler, Marlboro, NJ (US); William G. Redmann, Oak Park, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 09/261,398

(22) Filed: Mar. 3, 1999

(51) Int. Cl.[7] ..... A63F 9/24

(52) U.S. Cl. ..... 472/60; 472/62; 463/62; 463/58

(58) Field of Search ..... 463/6, 7, 58, 59, 463/60, 61, 62, 63; 340/323 R; 446/456, 454; 472/60, 62, 57, 137

(56) References Cited

U.S. PATENT DOCUMENTS

| | | | | |
|---|---|---|---|---|
| 3,515,802 | | 6/1970 | Wise . | |
| 3,826,864 | | 7/1974 | Paufve . | |
| 3,961,133 | | 6/1976 | Bennett . | |
| 3,978,934 | | 9/1976 | Schneidinger . | |
| 4,055,004 | | 10/1977 | Chase . | |
| 4,192,507 | | 3/1980 | Rains et al. . | |
| 4,199,875 | | 4/1980 | Barbarasch . | |
| 4,240,638 | | 12/1980 | Morrison et al. . | |
| 4,267,606 | | 5/1981 | Stelter et al. . | |
| 4,269,415 | | 5/1981 | Thorne-Booth . | |
| 4,281,876 | | 8/1981 | Lansberry . | |
| 4,324,301 | | 4/1982 | Eyerly . | |
| 4,326,719 | | 4/1982 | Tran et al. . | |
| 4,591,897 | | 5/1986 | Edelson . | |
| 4,680,012 | | 7/1987 | Morley et al. . | |
| 4,817,948 | * | 4/1989 | Simonelli | 446/456 |
| 5,076,584 | | 12/1991 | Openiano . | |
| 5,481,257 | | 1/1996 | Brubaker et al. . | |
| 5,816,913 | * | 10/1998 | Nakamura | 463/6 |
| 5,865,624 | * | 2/1999 | Hayashigawa | 463/6 |
| 5,910,046 | * | 6/1999 | Wada et al. | 463/6 |
| 6,117,007 | * | 9/2000 | Matsuyama et al. | 463/6 |
| 6,117,008 | * | 9/2000 | Machiguchi | 463/6 |
| 6,126,548 | * | 10/2000 | Jacobs et al. | 463/6 |

OTHER PUBLICATIONS

"Toys to Train Army" Popular Mechanics, pp. 142–147, Oct. 1965 By Arthur Whitman.

"Welcome to the Future of Remote Control Attractions" Thola Productions Press Release, Jun. 1996.

"The Hoverdrome" Thola Productions, Inc. Marketing Brochure, date unknown.

"XC–999/999P" Specification Sheets for One Piece Minature Color Camera Module, Sony Electronic, Inc. date unknown.

* cited by examiner

*Primary Examiner*—Michael O'Neill
(74) *Attorney, Agent, or Firm*—Christie, Parker & Hale, LLP

(57) ABSTRACT

An entertainment attraction (100) comprises remote-controlled, telepresence vehicles (204) and an environment (200) for the vehicles to traverse. The environment includes a plurality of reconfigurable portions (206). A vehicle includes an identification device (208) for providing an identifier and a camera (210) for imaging its field of view. A driver console (102) corresponding to a vehicle includes a monitor (212) for displaying the imaged field of view of the camera and a control device (214) for providing a driver-initiated control signal. A control system (218) includes detectors (220) dispersed about the environment. A detector is configured to receive the identifier or to sense the vehicle or both. The control system composes the interactions among the vehicles, the driver console, and the reconfigurable portions according to the received identifier, the sensing of the vehicle, or the driver-initiated control signal or some combination thereof.

25 Claims, 5 Drawing Sheets

304
204
242
268
POWER SUPPLY
240
244
270
210
203
202
208
220
300
221
236
234
302
232
246
238
235
226
206

INTERACTIVE ENTERTAINMENT ATTRACTION USING TELEPRESENCE VEHICLES

FIELD OF THE INVENTION

The present invention relates generally to the field of entertainment attractions, and, more particularly, to interactive game systems. Although the present invention is subject to a wide range of applications, it is especially suited for use in a "Treasure of the Incas®" interactive, telepresence maze-exploration game system and will be particularly described in that connection.

BACKGROUND OF THE INVENTION

An attraction, such as an interactive game system, provides an entertaining experience to the guests of the attraction, including the drivers and the spectators. A game system which provides an interesting experience for non-players (in addition to players) helps to establish an environment conducive to increased business for an entertainment facility.

One class of entertainment attractions employs remote-controlled (RC) vehicles that traverse a defined environment having definite boundaries, such as, miniature cars and a race course, miniature boats and a lagoon, or hovercrafts and a flat surface surrounded by a retaining wall or rail. In return for a coin or token paid to a cashier or entered into a driver console, a driver is allotted a predetermined amount of play time during which the driver can navigate a RC vehicle about the defined environment.

Typically, the RC vehicles and the defined environment are in direct view of the drivers, and the driver navigates the RC vehicle through the defined environment by watching the RC vehicle as it moves in the defined environment and among other RC vehicles, and making steering and throttle adjustments at the driver console. In addition to the entertainment provided by navigating the RC vehicle, the RC vehicle can trip sensors dispersed about the defined environment. Tripping a sensor can cause different events to occur in the defined environment, such as, flashing lights, squirting water, and fire effects. Examples of such entertainment attractions are provided by Thola Productions, Inc., of Laguna Hills, Calif.

In more sophisticated systems, the RC vehicle is identified by a sensor so that vehicle-specific responses can be made, such as, spinning out the RC vehicle or adding play time to the driver console. An example of this is a hovercraft game provided by Thola Productions, Inc.

Although capable of providing an entertaining experience, the scope of experiences available to the guests of typical attractions utilizing RC vehicles is somewhat limited. For example, the guests have a remote point-of-view of the interactions between the RC vehicle and the defined environment rather than a direct point-of-view, such as, a view obtained by being in the car or the boat, or on the race course or in the water. Thus, the guest cannot fully experience visually the acceleration, bumps, wakes, collisions, spin outs, or falls of the RC vehicles. Further, because the driver must be able to view the RC vehicle and the defined environment in order to navigate, navigation through a maze or night environment is not feasible because the driver could not see the vehicle through the walls of the maze or through the darkness. Thus, the driver is deprived of an entire class of experience, namely, exploration.

It is also the case that most forms of entertainment providing an exploration experience do so with a large real estate footprint, hedge mazes are an example that can cover 20,000 square feet; or are entirely virtual in nature, which "colors" the experience as artificial and deprives the designers of the capabilities available by using stagecraft techniques.

Another drawback of the typical entertainment attraction is that the reward to the driver for an achievement or failure is passive and limited. For example, an achievement is rewarded by flashing lights, extending play time, or executing a choreographed event in the environment; a failure is rewarded by the driver losing control of the RC vehicle as he watches it spin out of control. Consequently, the guests are subjected repetitively to a limited number of stimuli over which the driver has no control. Thus, the guest can lose interest in the entertainment attraction fairly quickly.

A further drawback is that the drivers and driver consoles are typically located adjacent the defined environment because of the need to directly view the vehicle to navigate it. Further, the spectators typically view the action from the perimeter of the defined environment. Consequently, the spectators' view of the defined environment and the action within can be obscured by the drivers and their consoles. Thus, the spectators may not be drawn to the game so as to become drivers themselves.

Still another drawback of the typical entertainment attraction is that play is usually interrupted while a game operator goes into the environment to retrieve an inoperable RC vehicle or return a repaired RC vehicle. Because the players desire non-stop operation, it is preferable that operable RC vehicles continue play while an RC vehicle is retrieved or returned.

An RC toy containing a television camera that uses a television module to display the point of view impressions of the RC vehicle has been described. Also known are miniature RC tanks with mounted television cameras in a simulated terrain. The simulated tanks' drivers view images of the terrain in front of the tank on a television monitor, and maneuver the tanks remotely. These applications, however, do not address employing an RC vehicle in an entertainment attraction.

A need therefore exists for an entertainment attraction that provides a more immersed and expansive entertainment experience to the guests than is possible with conventional entertainment attractions employing RC vehicles.

SUMMARY OF THE INVENTION

The present invention, which tends to address this need, resides in an entertainment attraction employing RC vehicles. The entertainment attraction described herein provides advantages over known entertainment attractions in that it provides a more immersed and expansive entertainment experience to the guests than is possible with conventional entertainment attractions employing RC vehicles.

According to the present invention, reconfiguring a reconfigurable portion of the environment in response to sensing a vehicle. This is accomplished by a detector, corresponding to the reconfigurable portion, that senses the vehicle; and a control system that reconfigures the reconfigurable portion in response to sensing the vehicle. Thus, knowing the vehicle is nearby, the control system can cause the reconfigurable portion to reconfigure in many possible configurations. Thus, the guests' entertainment experience can be increased as the guests are not subjected to the same repetitive environmental response. Instead, the game can "remember" a guest's prior experience and not retrigger or repeat a performance (that is, reconfigure) except for another guest vehicle that has not viewed that particular performance.

In one aspect of the invention, reconfiguring the reconfigurable portion according to a received identifier. This is accomplished by the detector, corresponding to the reconfigurable portion, that receives an identifier of the vehicle, and the control system reconfigures the reconfigurable portion according to the received identifier.

In further accordance with the present invention, providing an overlay over a displayed field of view of a camera of the vehicle. This is accomplished by the detector sensing the vehicle and, in response, the control system providing the overlay over the displayed field of view. Thus, the driver's visual experience is increased as the driver's view is not limited to the video display of the vehicle's camera.

In one aspect of the invention, selecting the overlay from a plurality of overlays according to the received identifier. Thus, the driver's entertainment experience is increased as the driver is not subjected to the same overlay when the vehicle is sensed at a later time.

In another aspect of the invention, the overlay is selected from a plurality of overlays according to a driver-initiated control signal. Thus, the driver's entertainment experience is increased as the driver is not subjected to the same overlay when the vehicle is sensed. Furthermore, the driver is more immersed in the game as the driver must make choices that affect his visual experience.

Also in accordance with the present invention, making the vehicle appear to go faster than its actual speed as viewed by the displayed field of view of the camera of the vehicle negotiating the maze is viewed. This is accomplished by walls of a maze arranged to form corridors of sufficient dimension relative to the size of a vehicle. Thus, the driver views the entertaining experience of apparently increased speed.

Also still further in accordance with the present invention, reconfiguring the reconfigurable portion according to the driver-initiated control signal. This is accomplished by the control system. Thus, the guests' entertainment experience is increased as they are not subjected to the same repetitive environmental response. Furthermore, the driver is more immersed in the game as the driver must make choices that affect his visual experience.

In further accordance with the present invention, arranging the entertainment system to allow spectators to better view the interactions among the environment and vehicles. This is accomplished by disposing the environment out of direct view of a plurality of game players located at the plurality of driver consoles but in direct view of the spectators watching the plurality of vehicles traversing the environment. Thus, the view of the spectators is not impeded by the driver and the driver consoles.

In one aspect of the invention, the environment is disposed below a level of a floor supporting the plurality of spectators. Thus, the spectators can see the vehicle action in the environment.

In a detailed aspect of the present invention, the environment is covered by a transparent portion of the floor. Thus, the spectators can walk over the environment to obtain a better view of the central portion of the environment.

In another detailed aspect of the present invention, the transparent portion of the floor includes removable tiles. Consequently, the operator can reach into the environment from the location of a removed tile to retrieve an inoperable RC vehicle and to return a repaired RC vehicle. Thus, the operable RC vehicles can continue play without being disturbed by the operator.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

Figure 1:
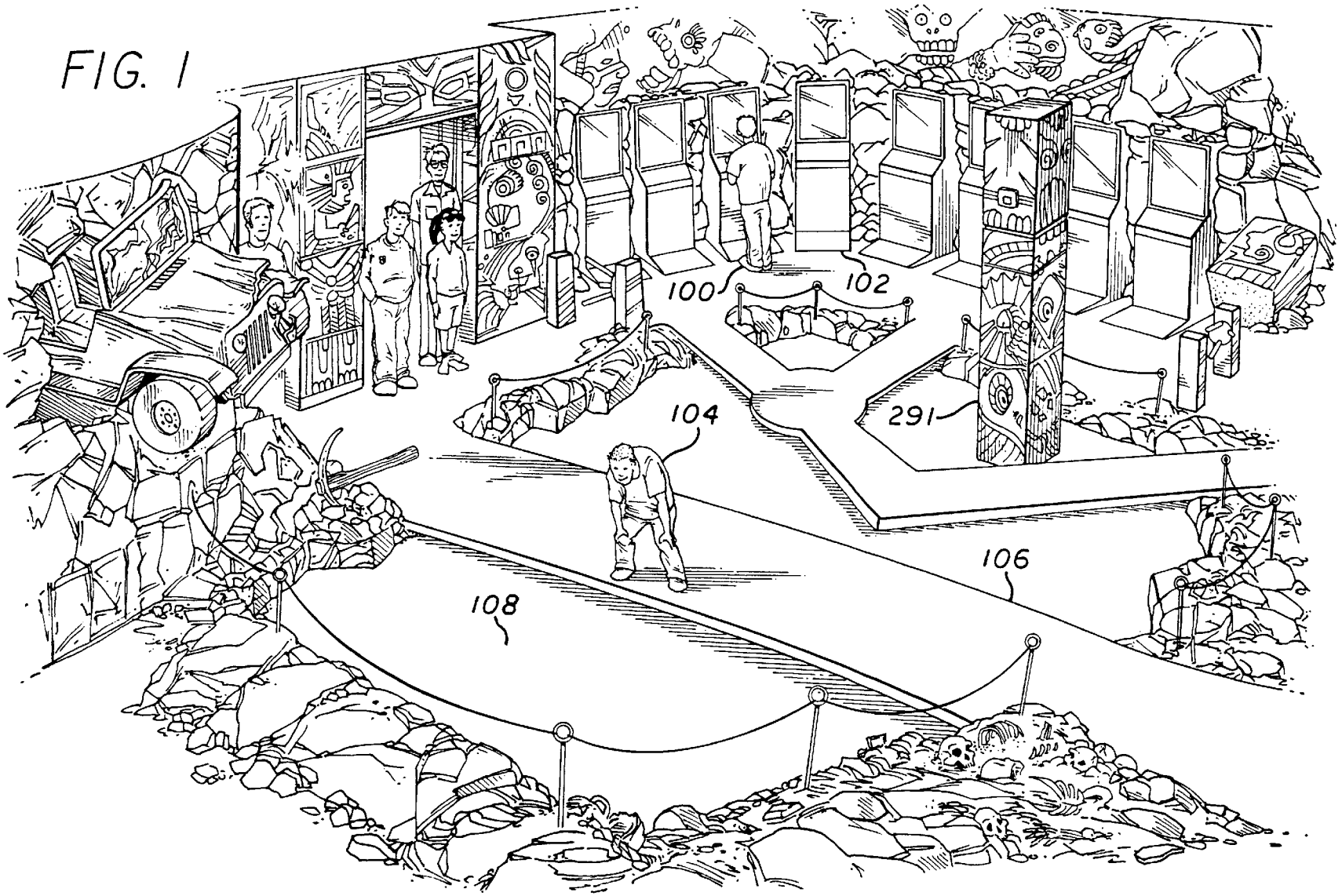
FIG. 1 is a partial perspective view of an entertainment attraction configured according to the present invention.

As shown in the exemplary drawings, and with particular reference to FIG. 1, which is a partial perspective view of an entertainment attraction 100 configured according to the present invention, the present invention is embodied in the "Treasure of the Incas®" entertainment attraction comprising a plurality of RC vehicles, an environment for the plurality of vehicles to traverse, and a plurality of driver consoles 102. Each driver console 102 corresponds to one vehicle of the plurality of vehicles.

In this illustrated embodiment, the environment is disposed out of direct view of a plurality of game players 103 located at the plurality of driver consoles 102 but in direct view of a plurality of spectators 104 watching the plurality of vehicles traversing the environment. The environment is disposed below a level of a floor 106 that can support the plurality of spectators 104. The environment is covered by a transparent portion 108 of the floor 106, and the transparent portion 108 of the floor 106 includes removable tiles.

Figure 2:
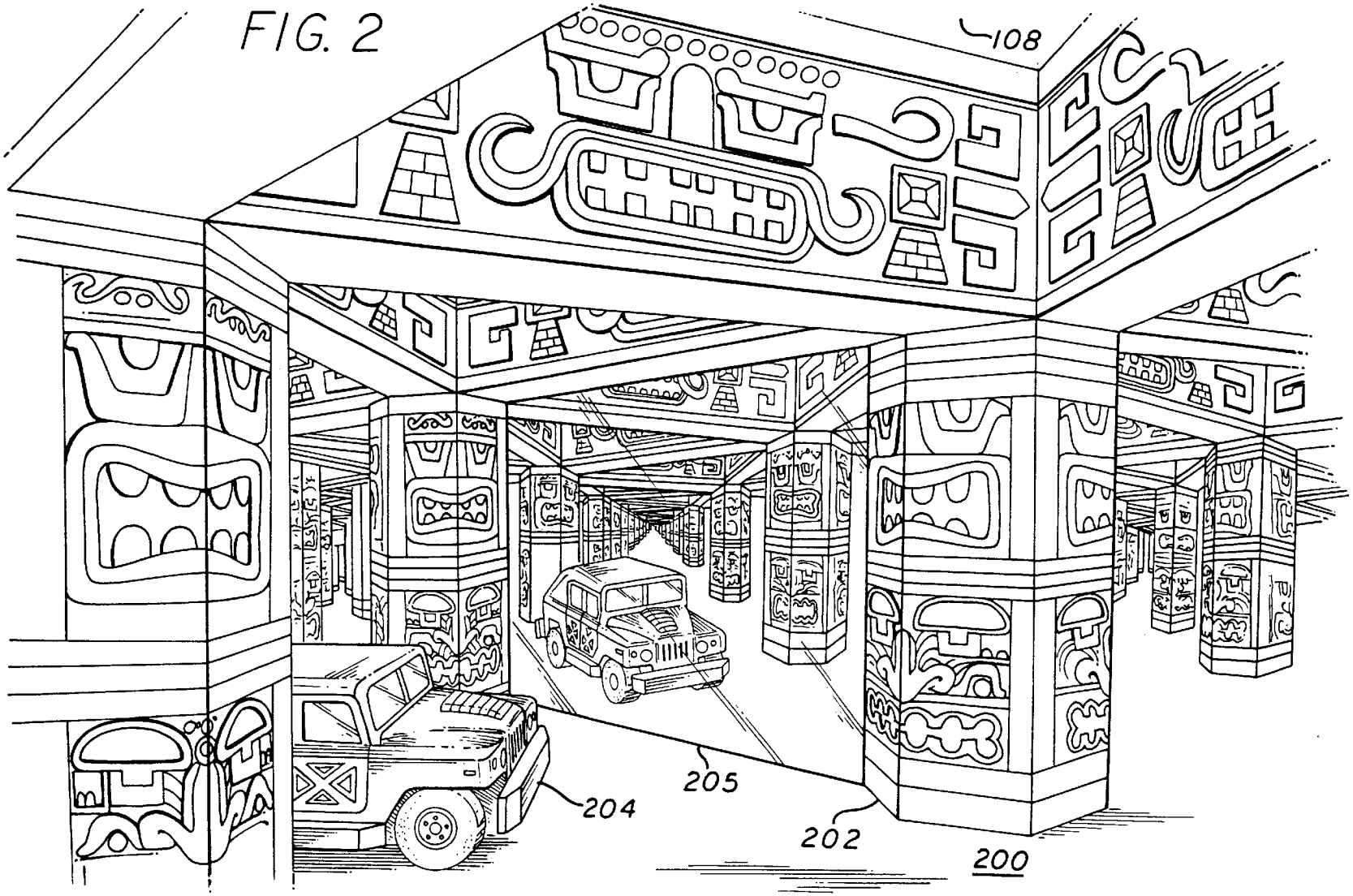
FIG. 2 is a perspective view inside the environment of the entertainment attraction shown in FIG. 1, particularly illustrating an interior of a maze.

Referring to FIG. 2, which is a perspective view inside the environment 200, the environment 200 includes a plurality of walls 202 arranged to form a maze with corridors of sufficiently narrow dimension for the plurality of vehicles 204 to negotiate. The corridors are of sufficient dimension relative to the size of the vehicle 204 to give the appearance that the vehicle is going faster than its actual speed as viewed by a displayed field of view (FOV) of a camera mounted on the vehicle 204 negotiating the maze. If vehicle is to turn in place, the corridor width would preferably be 110% of the diagonal length of the vehicle. If vehicles are to pass in the corridor, the corridor width would preferably be 210% of the width of the vehicle. In a preferred embodiment, the corridor width is approximately 400% of the vehicle width or 225% of its length, whichever is greater. This allows sufficient room for vehicles to pass each other, and also to turn around in place. The corridors preferably do not exceed 4 times the vehicle width, otherwise the exaggerated vection effect is lost and a manageable vehicle speed will appear to be excessively slow. In a preferred embodiment, the corridor width is 145% of the car length and 267% of the car width.

Walls 202 contain supports 203 for transparent segments of the floor 108. Preferably the model floor 246 consists of conductive metal strips of opposite electrical polarity which provides the plurality of vehicles 204 with power and optionally control signals as described below.

In order to make the environment 200 a more intriguing maze, the grid on which it is based is triangular, rather than square. This makes the maze visually more interesting. The triangle grid also allows for the use of mirror-maze effects, such as, the infinite corridor effect shown in FIG. 2, by incorporating mirrors 205 as walls. Other angles can also be used.

Figures 1, 3:
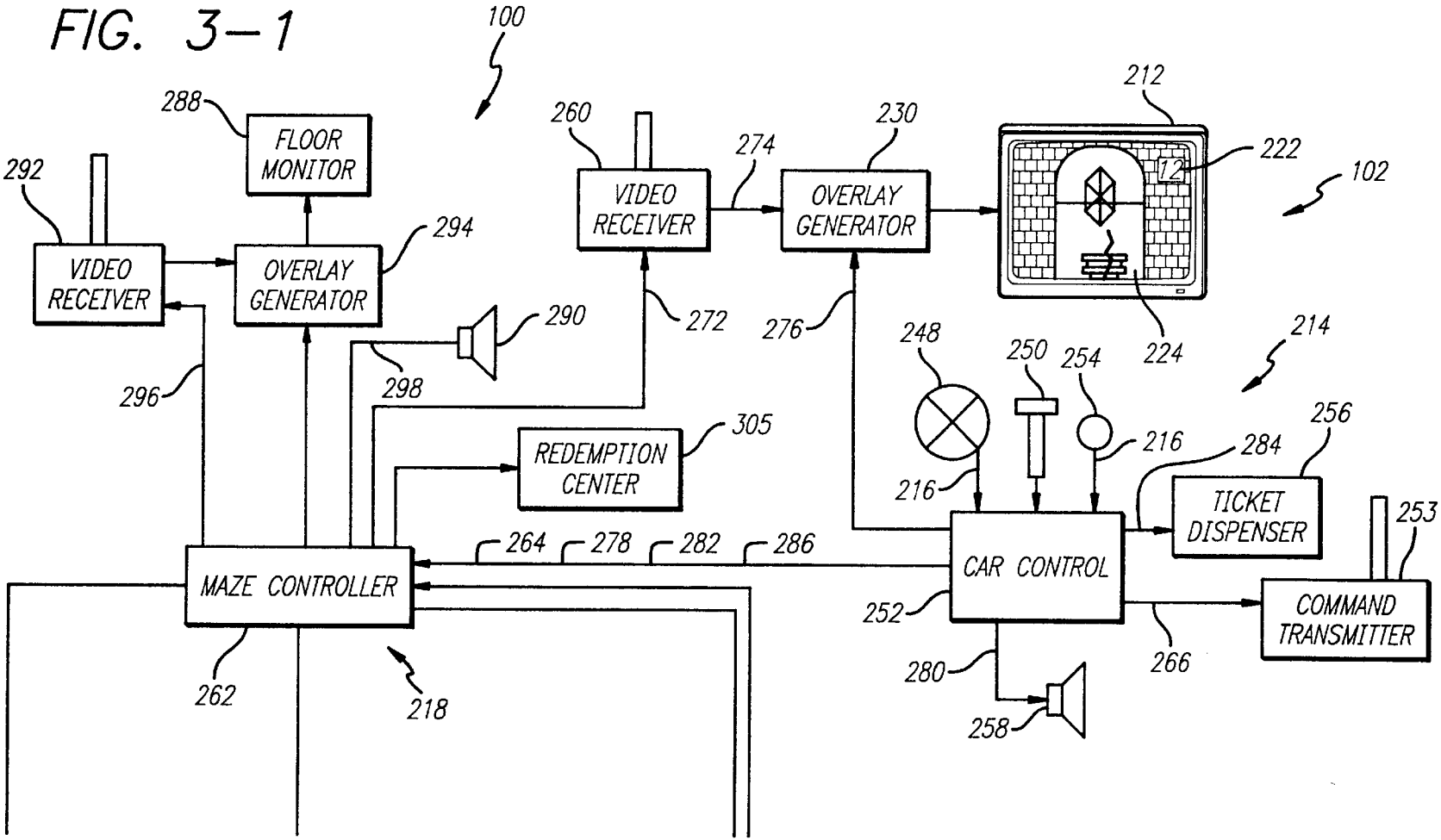
FIG. 3 is a simplified functional block diagram of the entertainment attraction, including a simplified side elevation view of a vehicle at the entrance of a reconfigurable portion of the environment.
Figures 2, 3:
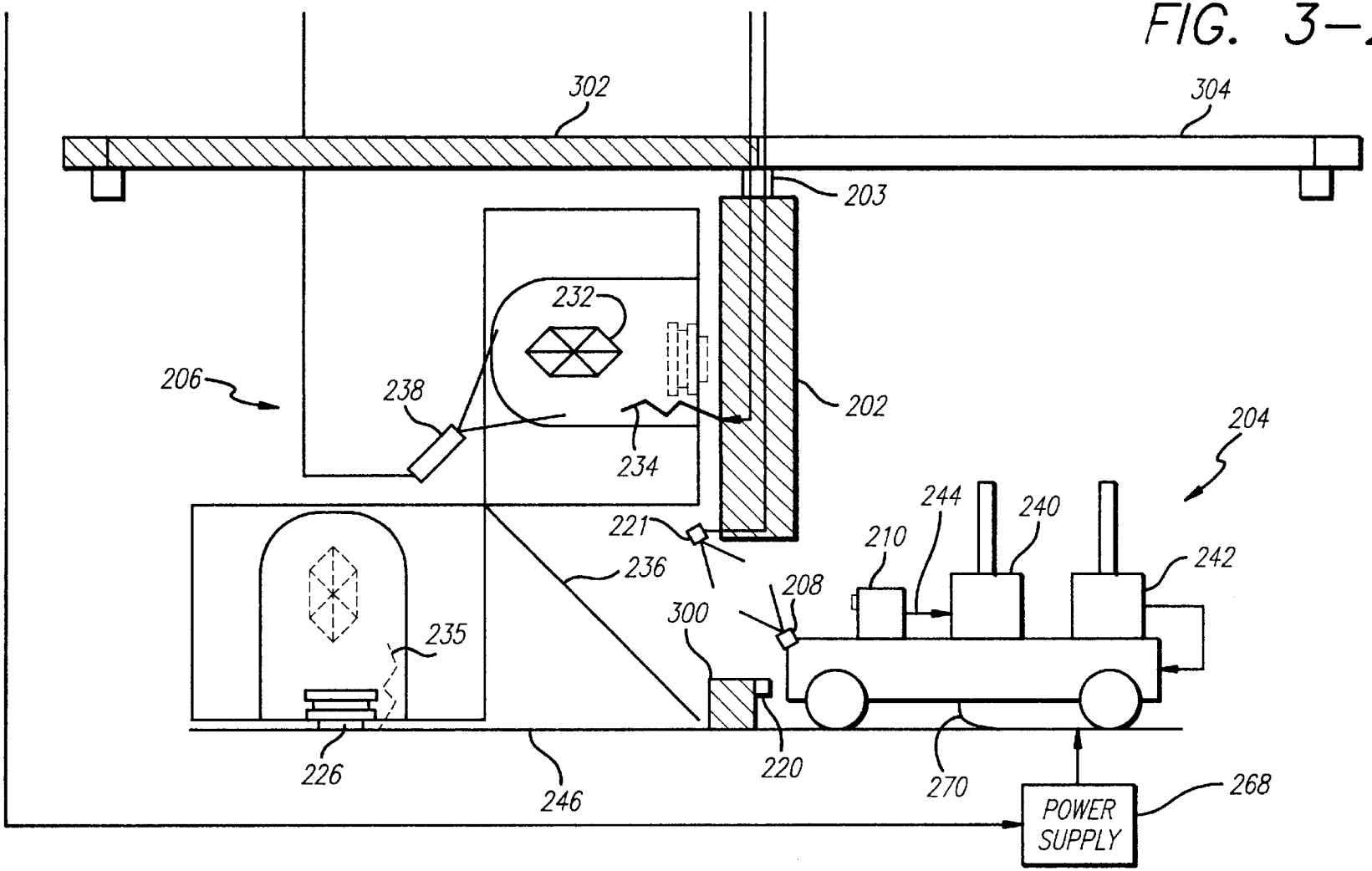

Referring to FIG. 3, which is a simplified finctional block diagram of the entertainment attraction 100, including a simplified side elevation view of the vehicle 204 at the entrance of a reconfigurable portion 206 of the environment 200.

Each vehicle 204 is preferably equipped with high slip differential steering. Preferably, all of the vehicle's two or more wheels are driven: the drive wheels of the left side are driven together and those on the right side are driven separately. The vehicle can be driven forward and reverse by matching the rate of turn of all drive wheels. It can be turned by controlling the left side drive wheels to turn at a different rate than the right side drive wheels. Turning in place can be accomplished by rotating the drive wheels of one side at a rate equal to, but opposite from the drive wheels of the opposite side. The wheels can be made of nylon or some other hard, low friction material that allows the high degree of slip seen in such turning maneuvers, but without scuffing the floor or causing excessive particulate production from wear.

Each vehicle 204 includes an identification device 208 for providing an identifier that uniquely identifies each vehicle 204 from all other vehicles 204. Each vehicle 204 also includes a camera 210 for imaging the FOV of the camera 210, and each driver console 102 includes a monitor 212 for displaying the imaged FOV of the camera 210 of the corresponding vehicle 204. Each driver console 102 further includes a control device 214 for providing a driver-initiated control signal.

Alternatively, camera 210 can provide a stereo video field of view. This can be achieved with any of the well known methods (for example, separate cameras, anaglyphic filters over a binocular prism, binocular to over/under prism such as described in U.S. Pat. No. 5,193,000, shuttered binocular prism using field interlace, etc.). Monitor 212 and overlays 222 would display and be generated, respectively, by a compatible technique, and the driver would use or wear appropriate 3D viewing equipment as needed.

A control system 218 is communicatively coupled with the plurality of vehicles 204, the plurality of driver consoles 102, and the plurality of reconfigurable portions 206. The control system 218 includes a plurality of detectors 220. Each detector 220 corresponds to one reconfigurable portion of the plurality of reconfigurable portions 206. A detector 220 is configured to receive the identifier of the vehicle 204 and to sense the vehicle 204, and the control system 218 is programmed to compose, according to the received identifier, the sensing of the vehicle 204, and the driver-initiated control signal 216 of the driver console 102 that corresponds to the vehicle 204, the interactions among the vehicle 204, the driver console 102 corresponding to the vehicle 204, and the reconfigurable portion 206 that corresponds to the detector 220 that received the identifier of the vehicle 204.

The interactions can include reconfiguring, in response to sensing the vehicle 204, the reconfigurable portion 206 corresponding to the detector 220 that sensed the vehicle 204; and providing, in response to sensing the vehicle 204, an overlay over the FOV of the camera 210 of the vehicle 204 that is displayed on the monitor 212. Furthermore, the overlay 222 can be selected from a plurality of overlays 222 according to the received identifier. The reconfiguring of the reconfigurable portion 206 can be performed according to the received identifier. Moreover, the reconfiguring of the reconfigurable portion 206 and the selection of the overlay 222 from the plurality of overlays 222 can be performed in accordance with the driver-initiated control signal 216.

One example of the overlay 222 over the FOV displayed on the monitor 212 is illustrated in the functional block diagram of FIG. 3. In the background of the displayed FOV 224 is the image of pedestal 226 and the "practical effects" of the environment. Video overlay 222 can be used to replace some practical effects, for example, a neon bolt 234 having an effect image 235. The effect image 235 is preferably provided from video overlay 222 when possible. Alternatively, the image 235 can be provide by a practical effect within the environment and within the FOV of camera 210.

Figure 4:
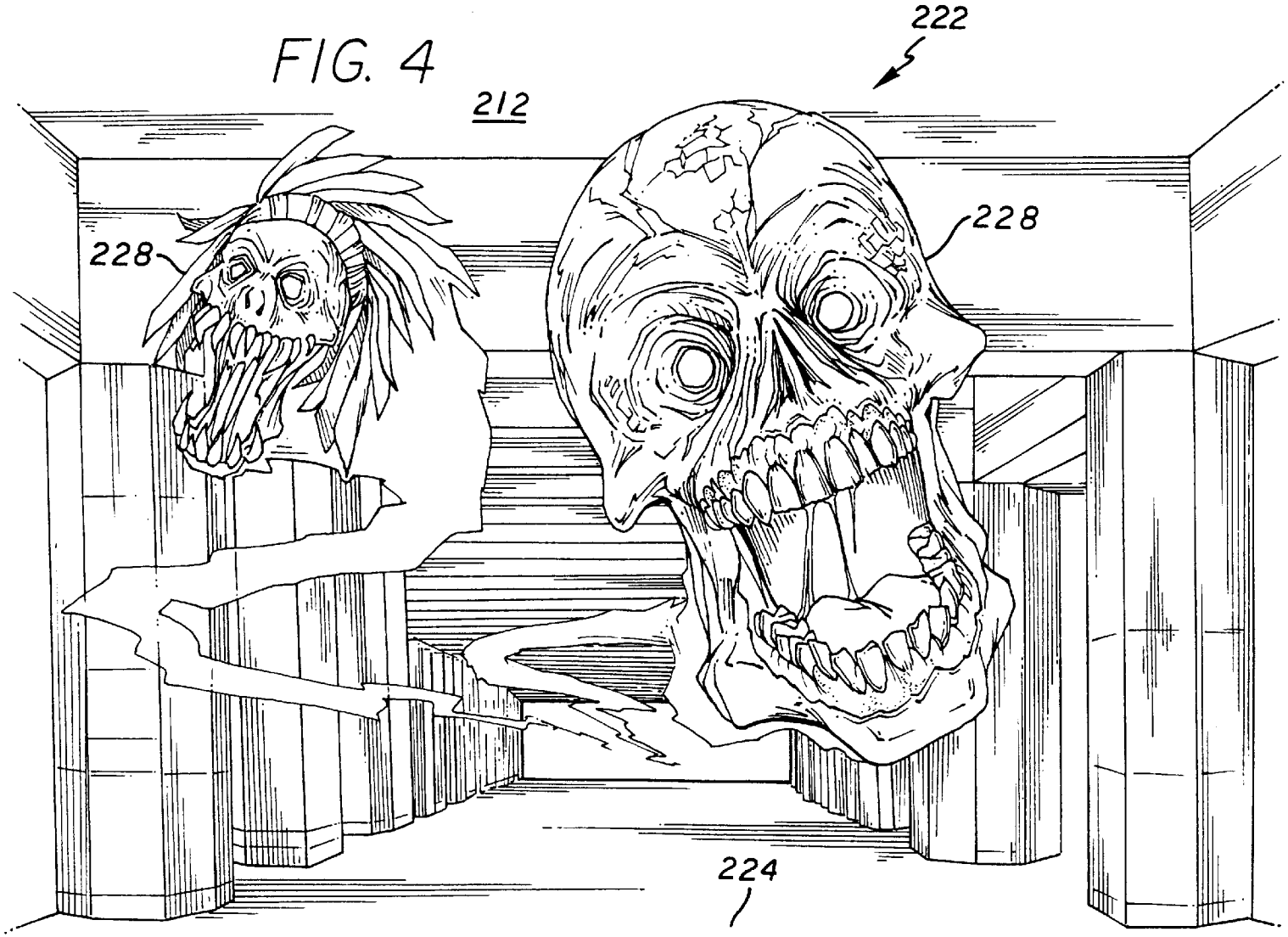
FIG. 4 is a schematic of an exemplary overlay over a field of view displayed on a monitor.

Another example of an overlay 222 over the displayed FOV 224 on a monitor 212 is illustrated in the schematic of FIG. 4. In the background, the displayed FOV 224 is the corridor of the maze the vehicle is negotiating. In the foreground, the overlay 222 is a "video effect" of the heads 228 of two phantoms streaking down the corridor towards the driver of the vehicle 204. Video effects can be imposed on or replace the telepresence video signal. The guest's view of the world can switch to static, or become wavy, by operating on it through a video switch or overlay generator. An overlay 222 of video from another source, e.g. a computer graphic system or computer controlled videodisc, can either replace or be keyed into the signal. This is useful for playing instructional or introductory program material, an attract loop, or a "game over" sequence on the console. The overlay can also be used to generate gauges or score information, as suggested in overlay 222 in FIG. 3.

An example of reconfiguring the reconfigurable portion 206 is illustrated in the schematic of FIG. 3. The FOV includes the pedestal 226 and the practical effects of a gem 232 and a neon bolt 234 (assuming it is not provided by video overlay) reflecting on a partially reflective glass 236. As the neon bolt 234 alternately turns on and off, its reflection on the glass 236 appears on the monitor 212 as bolt image 235, and the bolt 234 appears to flash. As a light 238 shining on a gem 232 turns on to off, the gem image 233 appears on the monitor 212 to disappear as its reflection no longer reflects off the partially reflective glass 236. Other examples of practical effects that alter the look of the set, or reconfigurable portion 206, which is seen by the guest via the telepresence equipment of the vehicle 204, can include collapsing walls, disappearing treasures, flashing lights, video playing on disguised monitors in the miniature set, a spinning turntable, a sliding wall, an illusion where an object apparently changes form, for example, from a human figure to a skeleton by having the two objects arranged around a half-silvered mirror so a viewer sees one object in the same apparent location as the other. Also, objects can be made to appear or disappear as well as other special effects commonly achieved through stagecraft.

The interactions can further include "control effects" affecting the vehicle 204. For example, the engine can be simulated to fail, the steering or motive abilities can act to avoid an area, the vehicle 204 can spin or charge forward out of control. The vehicle 204 can drive along a path or follow a "siren's song" as if under the hypnotic control of another agency or as if it were self motivated.

The entire "scripted" performance or interactions under control of the control system 218 can include, but is not limited to, any of the following: a) set modifications, b) video overlays, c) programmed vehicle moves, d) audio sequences including stereo effects and dimensional sound effects like binaural, e) alterations to video mixing, for example, fade-out the camera video, cause it to waver, such as, seeing through hot air or entering a dream sequence.

The script can be a "branching script" that produces different outcomes based on the following factors: a) vehicle identification: the vehicle 204 can have a "personality," for example, a bad idle that causes the engine to die in some scripts, whereas other vehicles 204 may not; b) vehicle history: for example, this vehicle 204 has been here recently and seen branch #1, so use branch #2 instead, or this vehicle 204 recently completed activity X, for example, finding a giant ruby, so that rather than branch #1, use branch #2 that is the "reward" script which thanks the player for his success; c) player interaction: if the player does nothing before the introductory script runs out, take branch #1, "Opportunity Lost," but if the player activates his control button, play branch #2, "Opportunity Seized," unless he hits it too early, in which case play branch #3, "Jumping the Gun Penalty," d) game time: for example, certain story elements may only be available during the first half of the game, and e) location history: if this portion of the environment has recently been left in a particular state following execution of a script, that state may call for a particular follow-up scripts should the vehicle 204 come upon it, perhaps limited by a timeout. This would permit the script to be run to depend upon the likelihood that the next vehicle 204 to come up had seen part of the previous sequence. For the sake of continuity, a direct repeat should be avoided.

Scripts do not have to be associated with a particular reconfigurable portion 206, because a detector 220 located anywhere in the environment 200 can trigger a video, audio, or steering effect. An example of this would be a region which causes the vehicle 204 to veer uncontrolled to the left, for example, a haunting that wards the driver away from a "forbidden entrance." Another location might be haunted by "banshees," which would cause a wailing sound to fly past the driver, maybe with some video apparition as illustrated in FIG. 4.

Accordingly, the entertainment attraction 100 configured according to the present invention provides a more immersed and expansive entertainment experience to the guests than is possible with conventional entertainment attractions employing RC vehicles.

Examples of the advantages include the following: the guests experience a varied environmental response; the driver's view includes not only the video display of the vehicle's camera but also overlays; the driver experiences varied overlays when the vehicle is sensed; the driver can make choices that affect his visual experience; the driver perceives an increased speed of the vehicle; the view of the spectators is free from the impediment of the driver and the driver consoles; the spectators can see the action in the environment; the spectators can obtain a better view of the central portion of the environment; and the operable RC vehicles can continue play without being disturbed by the operator retrieving and returning vehicles.

Referring back to FIG. 3, the construction of the entertainment attraction "Treasure of the Incas®" will now be described.

The vehicle 204 includes the camera 210, a video transmitter 240, a command receiver 242, and the identification (ID) device 208.

The camera 210 can be mounted on the vehicle 204 and images the FOV of the camera 210. An imaged FOV video signal 244 is provided to the video transmitter 240, and the imaged FOV video signal 244 is transmitted.

The command receiver 242 receives transmitted vehicle-command signals, and the vehicle 204 responds to the vehicle-command signals to steer, accelerate, and brake the vehicle 204, and to dim the head lights, or other on-vehicle effects or devices (not shown), for example a simulated burning flame effect within the model vehicle's passenger compartment, which might be used to indicate a vehicle whose time has expired. The command receiver 242 can receive, for example, infrared or radio-frequency vehicle-command signals as shown in FIG. 3, or preferably, vehicle-command signals represented by different voltage levels, sensed by brushes 270, from a floor 246 of the environment 200.

The ID device 208 can be mounted on the vehicle 204 and provides an identifier uniquely identifying the vehicle 204. The ID device 208 can be, for example, an infrared (preferred) or radio-frequency transmitter or a bar code label. The identifier signal can be a serially transmitted character repeatedly generated from a UART, or, preferably a pulse synchronous to a specific command pulse received at command receiver 242.

The driver console 102 includes a steering wheel 248, a throttle 250, a vehicle controller 252, a command transmitter 253, collect button 254, a ticket dispenser 256, speakers 258, the driver monitor 212, the overlay generator 230, and a video receiver 260.

Although not shown, the driver console 102 can include a barcode reader for reading a barcoded card that has a prepaid amount play time or number of games. The play time or number of games are deducted for each use. In another embodiment, a coin slot can be used to activate the game.

The steering wheel 248, the throttle 250, and the collect button 254 generate the driver-initiated control signals 216 in response to their operation as described in the portion of this written description describing the operation of the entertainment attraction 100. Furthermore, a maze controller 262 can provide vehicle-override control signals 264. The driver-initiated control signals 216 for the steering wheel 248 and throttle 250 and the vehicle-override control signals 264 are received by the vehicle controller 252, and, in response, the vehicle controller 252 provides a vehicle-command signal 266. The vehicle-command signals 266 are transmitted over the command transmitter 253 and is received by the corresponding command receiver 242. Preferably, the vehicle-command signals 266 are composed in maze controller 262, and provided via a power supply 268, the maze floor 246, and brushes 270 mounted on the vehicle 204. Preferably, the steering wheels 248 and throttles 250 can communicate direction with maze controller 262 and generate vehicle control signals for transmission to the corresponding vehicles 204 through commands transmitted via the power connection through the floor. This has the advantage of lowering costs by not requiring analog-to-digital converters at each driver console 102.

The video receiver 260 receives a channel-control signal 272 from the maze controller 264. In response, the video receiver 260 tunes to a channel for receiving the corresponding transmitted FOV.

If desired, for cost savings, the video receivers 260 and 292 can be assigned and set to a fixed frequency. The video transmitters 240 are microwave transmitters that can operate on 10 narrowband channels in a 120 MHz band within the 1990 to 2110 MHz electronic news gathering band, or other bands and channels suitable for transmission in the environment and to obtain the desired function.

To prevent loss of signal due to signals being blocked by obstacles such as architectural elements, such as columns 291 (see FIG. 1), multiple receiving antennae can be attached to the ceiling above the environment or, preferably, to the walls within the environment or both. Use of metal objects should be avoided within the model environment 200 above the base of the video transmitting antenna aboard the vehicles 204, to avoid reflections or blocking of the video transmission. For example, the frame supporting the floor can be made of fiberglass rather than metal. The video transmitting antennae and receiving antennae can be an omni-directional, circularly polarized stick antenna to increase the rejection of reflected or unpolarized signals.

Preferably, the signals received by the antennae are split, such that each of the video receivers 260 and 292 receives a signal from each antenna. By this means, each video receiver would decode and dynamically evaluate the video signal on its assigned channel from each of the antennae and select that video signal having the highest quality. By this process, if the best signal is suddenly interrupted because the transmitting antenna of corresponding vehicle's video transmitter 240 is carried by the vehicle 204 behind a column 291 relative to the receiving antenna having born that signal, then the video receiver would immediately select the video signal on that same channel that is the new best signal. This selected video signal becomes a FOV video signal 274, and via the overlay generator 230 is displayed on monitor 212.

An example of the antenna, video transmitter, and video receiver suitable for use in this embodiment of the invention is available from Dynatech Tactical Communications (DTC), Inc., of New Hampshire.

The received FOV video signal 274 is provided to the overlay generator 230. The vehicle controller 252 provides an overlay-control signal 276 in response to the driver-initiated signals 216 and an overlay-override control signal 278. The overlay generator 230 selects the overlay 222 in response to the overlay-control signal 276, combines the overlay 222 and received FOV video signal 274, and provides an overlaid FOV to the driver monitor 212 for display.

The vehicle controller 252 further provides an audio signal 280 to the speakers 258, and the speakers 258 provide audio in response, to at least the driver. The vehicle controller 252 generates the audio signal 280 in response to the driver-initiated signals 216 and an audio control signal 282 provided by the maze controller 262.

The vehicle controller 252 further provides a dispenser-control signal 284 to the ticket dispenser 256, and the ticket dispenser 256 provides redemption tickets in response. The vehicle controller 252 generates the dispenser-control signal 284 in response to the driver-initiated signals 216 and a ticket control signal 286 provided by the maze controller 252.

In another embodiment, overlay-override control signal 278, audio control signal 282, and ticket control signal 286 can be originated internally by vehicle controller 252, which is programmed to respond to a trigger signal (not shown) from maze controller 262.

A floor monitor 288 and associated speakers 290, video receiver 292 , and overlay generator 294 are constructed and function similar to those of the driver console 102; except the maze controller 262 selects the FOV of a particular vehicle 204 for displaying on the floor monitor 288 via an optional channel-control signal 296, receives the driver-initiated signals 216 from the corresponding vehicle controller 252, and simulates the vehicle controller 252 for generating the optional channel-control signal 296, the audio 298, and the overlay-control signal 276. The maze controller 262 can also generate control signals independent of a vehicle controller 252. Such a configuration could be used if it were desired to allow a driver console 102 to switch dynamically between multiple vehicles 204.

The environment 200 includes the floor 246, reconfigurable portions 206, detectors or sensor 220, a barrier 300, and the walls 202 defining the maze.

The floor 246 can be electrically conductive, for example, composed of alternately assigned power and ground metallic strips, and be energized by the power supply 268 under control of the maze controller 262. The vehicle 204 can receive its power via the energized floor 246 and brushes 270. Multiple brushes can provide power to the vehicle 204 through an on-board full-wave bridge rectifier. Furthermore, and preferably, the vehicle 204 can receive its vehicle-command signal 266 via the floor 246, the command signal being superimposed on the power supplied to the vehicles 204.

The reconfigurable portion 206 can be defined by at least one wall 202 having a portal formed therein for viewing the interior of the reconfigurable portion 206. At least one detector 220 is disposed at a location adjacent the wall 202 for sensing the identifier of the identification device 208 of an approaching vehicle 204. The detector 221 can be, for example, an infrared or radio-frequency receiver or a bar code reader.

The barrier 300 positions the approaching vehicle 204 for appropriate viewing of the interior of the reconfigurable portion 206 through the portal. Another detector 221, for example, an active infrared proximity detector, detects the proper positioning of the vehicle 204 for viewing the interior of the reconfigurable portion 206. An example use in conduction with detector 220 would be upon detecting with detector 220 the rough proximity and orientation of the corresponding vehicle 204, overriding the steering and throttle command to instruct that vehicle to drive forward for a moment in an attempt to drive that vehicle to dock with reconfigurable portion 206. This docking, if successful, would be detected by detector 221.

Another way to determine correct position and orientation of the vehicle 204 is to place visual markers (not shown) so that they fall into a certain position in the camera's field of view when the vehicle 204 is in the correct position. A computer at the driver console 102 can read the video signal, examine that certain position and look for a marker. The entire screen can be searched for the presence of the marker, then the trigger to start the reconfiguration can occur without the constraint that the vehicle be in an exact position. Further, the overlay 222 can be shifted to dynamically align to the marker (e.g., an overlay 222 containing an image of animated torch flames would always be drawn to align with a marker that indicates the position of torch sconces. If present, the marker can contain an encoding which could be extracted from that portion of the video and interpreted by the computer to identify the vehicle's position and orientation. A simple example of a marker would be a bar code. Or, it might be implemented as contrasting color stripes or patches of unique colors, so as not to appear as incongruous as a zebra-striped barcode.

The reconfigurable portion 206 is preferably covered by an opaque floor tile 302 that conceals the interior workings from the spectators 104, and the maze portion of the environment 200 is covered by transparent floor tile 304 that allows viewing of the vehicles 204 scurrying about the maze by spectators 104.

In this embodiment, the control system 218 includes the maze controller 262 and the vehicle controller 252 of each driver console 102. One of ordinary skill can appreciate that the control system 218 can be housed in separate components of the entertainment attraction 100 (as shown in FIG. 3) or be combined. Further, the control signals can be generated by either controller. For example, control signals for the special effects of the reconfigurable portions 206 can be provided by each vehicle controller 252 to each reconfigurable portion 206.

The entertainment attraction 100 described above can be constructed to provide the aforementioned functionality from readily available components and techniques known in the art. For example, the camera 210 can be a one-piece miniature color camera module model number XC-999/999P with a lens model number XCL-06512XM, available from Sony Electronics, Inc., of San Jose, Calif. The vehicles 204, environment floor 246, power supply 268, and maze controller 262 are available from Thola Productions of Laguna Hills, Calif.

One illustrative embodiment of a method of use and operation of the entertainment attraction "Treasure of the Incas®" constructed as described above will now be described in some detail below. In the interest of clarity, not all features of an actual implementation are described in this specification. In the development of any such actual implementation, numerous decisions must be made to achieve specific goals, which will vary from one implementation to another. It thus will be appreciated that such an effort could be expected to be complex and time consuming, but would nevertheless be a routine undertaking of development for those of ordinary skill having the benefit of this disclosure and knowledge of the functions described herein.

The "Treasure of the Incas®" is a suspense filled exploration and treasure hunt within a maze-like archaeological dig. The driver navigates by driving through the ruins of ancestral tombs. From a driver console 102, the driver steers a telepresence, RC car 204 through an 800 to 1000 square foot miniature maze. The monitor 212 in the driver console 102 displays video from the camera 210 mounted on the RC car, virtually placing the driver in the maze.

On the driver monitor 212, and on the floor monitors 208 above the spectator floor 106, a FOV perspective cruises the darkened, crumbling ruins of an ancient subterranean civilization. Guests are attracted to the entertainment attraction by the video segment shown on the driver monitors 212 and the floor monitors 208 as well as the show provided by the maze model under the transparent floor 304. The video segment introduces a story line.

An attracted guest approaches a driver console 102. Upon inserting a smart card or other debiting scheme, a short introduction plays. The guest then sees a few seconds of canned video of a princess exhorting the player to preserve the tombs and sacred objects in the maze from cowardly thieves (mutually, the other players) that have arrived to plunder the tombs of Incan royalty for mere profit. Within the maze are hidden tombs with treasures. Each tomb is a reconfigurable portion 206 with styling that follows the story line.

The princess promises to reward the driver for every treasure vault secured. Her final caution informs the driver that the wrathful spirits still lurk within the labyrinth, jealously guarding the ancient treasure. The driver will be greatly rewarded if he captures all the treasures.

There is a brief instructional dialogue explaining the driver console controls for steering, speed, forward/reverse, and collecting treasures. The visuals then switch to a FOV of whichever vehicle the control system 218 has found available or, alternatively, to the one permanently assigned. The driver takes the steering wheel 248 and throttle 250. The driver is subsequently free to explore the maze.

The image of the princess fades to the FOV showing a view of the interior of the labyrinth. The driver uses throttle 250, to move the vehicle 204 forward or reverse at speeds proportional to the lever throw. The lever's spring-return center position is also a neutral position. The proportional steering wheel 248 turns the vehicle 204 and spring-returns to a center position. If the steering wheel 248 is turned to the extreme left or right while the shift lever is in neutral, the vehicle 204 turns about its own axis.

As the driver explores, the gloom of the maze is probed by the vehicle's headlights where the show lighting goes dark. Stereo sound effects and music keyed to various locations throughout the maze heightens the mysterious nature of the images, and play from speakers 258 on either side of the driver's viewing area.

The driver encounters supernatural hazards, keyed by detectors 220 in the environment, which manifest themselves as video imagery overlaying and obscuring the main FOV. If the driver has made insufficient headway (for example, judged by percentage of time the vehicle is in motion) for any reason, the control system 218 will reduce the number of interference hazards placed in the path of the driver, and restate the driving instructions. If the vehicle 204 fails to move at all, a quick audio prompt will restate instructions for driving the vehicle 204.

Overlaid imagery is linked to special blocks of control code that the control system 218 (from either maze controller 262 or vehicle controller 252) transmits to the vehicle 204, giving the sensation of a supernatural power momentarily wresting control of the vehicle 204 from the driver. The driver monitor 212 fills with an ethereal presence of a shrieking demon 228, after which the driver finds that his vehicle 204 has turned 180 degrees. These hazards are used as non-material methods of altering the logic of the maze. They can also be used by the control system 218 to steer drivers away from congested locations within the maze.

In approaching a treasure tomb 206, the driver's vehicle 204 is detected by a detector 220 and the maze controller 262 is cued, and the treasure tomb 206 special effects and lighting are turned on. The portal to the treasure tomb 206 is shaped to physically place the vehicle 204 at its proper viewing position. Optionally, detector 221 can sense arrival at the proper viewing position if detector 220 is configured with a wide field of view and will accept the unique identifier provided by identification device 208 before the vehicle 204 is in proper viewing position. If a demon-guarded path is repeatedly tried and proper viewing position is not realized, an audio dialogue will inform a persistent player to try another approach to the treasure tomb 206.

Once in the proper viewing position, vehicle control is disabled, the vehicle's headlights are turned off if necessary to the effects desired (alternatively, the barrier 300 can simply be tall enough to block the headlights), and the appropriate overlay 222, or overlay sequence, is displayed. The image of the princess identifying the treasure is keyed to the FOV. The collect button 254 is illuminated prompting the driver to press it. At this point, lighting dims as an overlaying icon materializes representing the treasure. The icon shrinks on the monitor 212, and moves to its appointed station on the right margin of the driver monitor 212. Another preferable alternative is to light a separate lamp (not shown) at the driver's console 102, to indicate treasures found. The advantage of this is that it does not clutter the monitor 212, but it does increase cost of the console. Celebration music is keyed, and vehicle control is restored to the driver, preferably after the vehicle is automatically backed out and travels clear of the tomb, and the vehicle's headlights are turned on. The driver's score is optionally expressed in redemption tickets, and icons representing individual treasure tombs saved appear on the monitor (or lamp in the console).

An audio dialogue prompts the driver to push the collect button 254 if he failed to do so within ten seconds after reaching a treasure tomb 206. After twenty seconds the control system 218 will trigger the collect function for him. In another embodiment, another overlay can expel him from the tomb, if unsuccessful.

If the driver fails to secure any of the treasures when play time expires, the image of the princess appears thanking the player for his heroic, though unsuccessful, efforts. The guest is invited back for another try. At the ticket dispenser 256, a small number of redemption tickets are dispensed as "thanks." If some but not all of the treasures are secured, a moderate number of redemption tickets are dispensed for each treasure captured during play. The princess thanks the player for his achievements and invites him to return. If the driver captures all of the treasures, the princess lavishes honors upon the player, and instructs him that his reward will be great. The player is rewarded with a bounty of redemption tickets. There can also be a special trophy, in which case the control system 218 informs a redemption center 305 of this driver's achievement. A special trophy awaits him. The trophy can be in the form of a special Incan artifact cast in bottle glass, and available exclusively to those satisfying all the goals.

The driver can choose to ignore the stated goal and spend their time exploring the maze. In this event, the attraction plays like a spook-house with overlay effects and the minimum award of redemption tickets will be dispensed. If the driver's activity drops below a certain level, the control system 218 will reduce hazards and restate the driving instructions.

In conclusion, the entertainment attraction 100 described herein provides a more immersed and expansive entertainment experience to the guests than is possible with conventional entertainment attractions employing RC vehicles. This is primarily accomplished by composing, the interactions among the vehicle, the driver consoles, and the reconfigurable portions according to the received identifier, the sensing of the vehicle, or the driver-initiated control signals or some combination thereof.

Those skilled in the art will recognize that other modifications and variations can be made in the entertainment attraction of the present invention and in construction and operation of this entertainment attraction without departing from the scope or spirit of this invention.

What is claimed is:

1. An entertainment attraction comprising:

a plurality of remote-controlled vehicles;

an environment for the plurality of vehicles to traverse, the environment includes a plurality of reconfigurable portions; and a control system communicatively coupled with the plurality of reconfigurable portions, the control system includes a plurality of detectors, each detector corresponds to one reconfigurable portion of the plurality of reconfigurable portions, a detector is configured to sense a vehicle, and the control system is programmed to reconfigure, in response to sensing the vehicle, the reconfigurable portion corresponding to the detector that sensed the vehicle.

2. The entertainment attraction of claim 1 further comprises:

wherein each vehicle further includes a camera for imaging a field of view of the camera;

a plurality of driver consoles, each driver console corresponds to one vehicle of the plurality of vehicles, each driver console includes a monitor for displaying the imaged field of view of the camera of the corresponding vehicle;

wherein the environment further includes a plurality of walls arranged to form a maze with corridors for the plurality of vehicles to negotiate, and the corridors are of sufficient dimension relative to the size of the vehicle to give the appearance that the vehicle is going faster than its actual speed as viewed by the displayed field of view of the camera of the vehicle negotiating the maze.

3. The entertainment attraction of claim 1 further comprises:

wherein each vehicle further includes a camera for imaging the field of view of the camera;

a plurality of driver consoles, each driver console corresponds to one vehicle of the plurality of vehicles, each driver console includes a monitor for displaying the imaged field of view of the camera of the corresponding vehicle;

wherein the control system is further communicatively coupled with the plurality of driver consoles, the detector is further configured to sense the vehicle, and, in response to sensing the vehicle, the control system is further programmed to provide an overlay over the displayed field of view of the camera of the vehicle.

4. The entertainment attraction of claim 1, wherein the environment is disposed out of direct view of a plurality of game players located at the plurality of driver consoles but in direct view of a plurality of spectators watching the plurality of vehicles traversing the environment.

5. The entertainment attraction of claim 1 further comprises:

a plurality of driver consoles, each driver console corresponds to one vehicle of the plurality of vehicles, each driver console includes a control device for providing a driver-initiated control signal;

wherein the control system is further communicatively coupled with the plurality of driver consoles, and the control system is further programmed to reconfigure, according to the driver-initiated control signal provided by the control device of the driver console corresponding to the vehicle, the reconfigurable portion corresponding to the detector that received the identifier of the vehicle.

6. The entertainment attraction of claim 1, wherein each vehicle further includes an identification device for providing an identifier that uniquely identifies each vehicle from all other vehicles, the detector is further configured to receive the identifier, and the control system is further programmed to reconfigure the reconfigurable portion according to the received identifier.

7. An entertainment attraction comprising:

a plurality of remote-controlled vehicles, each vehicle includes a camera for imaging a field of view of the camera;

an environment for the plurality of vehicles to traverse;

a plurality of driver consoles, each driver console corresponds to one vehicle of the plurality of vehicles, each driver console includes a monitor for displaying the imaged field of view of the camera of the corresponding vehicle; and a control system communicatively coupled with the plurality of driver consoles, the control system including a plurality of detectors dispersed about the environment, a detector is configured to sense a vehicle, and, in response to sensing the vehicle, the control system is programmed to provide an overlay over the displayed field of view of the camera of the vehicle.

8. The entertainment attraction of claim 7, wherein:

each vehicle further includes an identification device for providing an identifier that uniquely identifies each vehicle from all other vehicles;

the detector is further configured to receive the identifier of the sensed vehicle;

the overlay is selected from a plurality of overlays according to the received identifier.

9. The entertainment attraction of claim 7, wherein the environment includes a plurality of walls arranged to form a maze with corridors for the plurality of vehicles to negotiate, and the corridors of sufficient dimension relative to the size of the vehicle to give the appearance that the vehicle is going faster than its actual speed as viewed by the displayed field of view of the camera of the vehicle negotiating the maze.

10. The entertainment attraction of claim 7, wherein the environment is disposed out of direct view of a plurality of game players located at the plurality of driver consoles but in direct view of a plurality of spectators watching the plurality of vehicles traversing the environment.

11. The entertainment attraction of claim 7, wherein:

the environment includes a plurality of reconfigurable portions;

each detector corresponds to one reconfigurable portion of the plurality of reconfigurable portions;

each driver console includes a control device for providing a driver-initiated control signal;

the control system is further communicatively coupled with the plurality of reconfigurable portions, and the control system is further programmed to reconfigure, according to the driver-initiated control signal provided by the control device of the driver console corresponding to the vehicle, the reconfigurable portion corresponding to the detector that sensed the vehicle.

12. The entertainment attraction of claim 7, wherein:

each driver console further includes Control device for providing a driver-initiated control signal;

the control system is further programmed to select, according to the driver-initiated control signal provided by the control device of the driver console corresponding to the sensed vehicle, the overlay from a plurality of overlays.

13. An entertainment attraction comprising:

a plurality of remote-controlled vehicles, each vehicle includes a camera for imaging a field of view of the camera;

a plurality of driver consoles, each driver console corresponds to one vehicle of the plurality of vehicles, each driver console includes a monitor for displaying the imaged field of view of the camera of the corresponding vehicle; and an environment for the plurality of vehicles to traverse, the environment includes a plurality of walls arranged to form a maze for the plurality of vehicles to negotiate, and the walls are arranged to form corridors of sufficient dimension relative to the size of a vehicle to give the appearance that the vehicle is going faster than its actual speed as viewed by the displayed field of view of the camera of the vehicle negotiating the maze.

14. The entertainment attraction of claim 13, wherein the environment is disposed out of direct view of a plurality of game players located at the plurality of driver consoles but in direct view of a plurality of spectators watching the plurality of vehicles traversing the environment.

15. The entertainment attraction of claim 13 further comprises:

wherein the environment further includes a purality of reconfigurable portions;

wherein each driver console further includes a control device for providing a driver-initiated control signal;

a control system communicatively coupled with the plurality of reconfigurable portions and the plurality of driver consoles, the control system includes a plurality of detectors, each detector corresponds to one reconfigurable portion of the plurality of reconfigurable portions, a detector is configured to sense the vehicle, and the control system is programmed to reconfigure, according to the driver-initiated control signal provided by the control device of the driver console corresponding to the sensed vehicle, the reconfigurable portion corresponding to the detector that sensed the vehicle.

16. The entertainment attraction of claim 13, wherein the width of the corridors is the greater of 225% of the length and 400% of the width of a one of the plurality of remote-controlled vehicles.

17. An entertainment attraction comprising:

a plurality of remote-controlled vehicles;

an environment for the plurality of vehicles to traverse, the environment includes a plurality of reconfigurable portions;

a plurality of driver consoles, each driver console corresponds to one vehicle of the plurality of vehicles, each driver console includes a control device for providing a driver-initiated control signal;

a control system communicatively coupled with the plurality of reconfigurable portions and the plurality of driver consoles, the control system includes a plurality of detectors, each detector corresponds to one reconfigurable portion of the plurality of reconfigurable portions, a detector is configured to sense a vehicle, and the control system is programmed to reconfigure, according to the driver-initiated control signal provided by the control device of the driver console corresponding to the sensed vehicle, the reconfigurable portion corresponding to the detector that sensed the vehicle.

18. The entertainment attraction of claim 17, wherein the environment is disposed out of direct view of a plurality of game players located at the plurality of driver consoles but in direct view of a plurality of spectators watching the plurality of vehicles traversing the environment.

19. An entertainment attraction comprising:

a plurality of remote-controlled vehicles, each vehicle includes a camera for imaging a field of view of the camera;

a plurality of driver consoles, each driver console corresponds to one vehicle of the plurality of vehicles, each driver console includes a monitor for displaying the imaged field of view of the camera of the corresponding vehicle; and an environment for the plurality of vehicles to traverse, the environment disposed out of direct view of a plurality of game players located at the plurality of driver consoles but in direct view of a plurality of spectators watching the plurality of vehicles traversing the environment.

20. The entertainment attraction of claim 19, wherein the environment is disposed below a level of a floor supporting the plurality of spectators.

21. The entertainment attraction of claim 20, wherein the environment is covered by a transparent portion of the floor.

22. The entertainment attraction of claim 20, wherein the transparent portion of the floor includes removable tiles.

23. An entertainment attraction comprising:

a plurality of remote-controlled vehicles, each vehicle includes, an identification device for providing an identifier that uniquely identifies each vehicle from all other vehicles, and a camera for imaging the field of view of the camera;

an environment for the plurality of vehicles to traverse, the environment includes a plurality of reconfigurable portions;

a plurality of driver consoles, each driver console corresponds to one vehicle of the plurality of vehicles, each driver console includes, a monitor for displaying the imaged field of view of the camera of the corresponding vehicle, and a control device for providing a driver-initiated control signal; and a control system communicatively coupled with the plurality of vehicles, the plurality of driver consoles, and the plurality of reconfigurable portions, the control system includes a plurality of detectors, each detector corresponds to one reconfigurable portion of the plurality of reconfigurable portions, a detector is configured to receive the identifier of a vehicle and to sense the vehicle, and the control system is programmed to compose, according to the received identifier, the sensing of the vehicle, and the driver-initiated control signal of the driver console that corresponds to the vehicle, the interactions among the vehicle, the driver console corresponding to the vehicle, and the reconfigurable portion that corresponds to the detector that received the identifier of the vehicle.

24. The entertainment attraction of claim 23, wherein the environment further includes a plurality of walls arranged to form a maze with corridors for the plurality of vehicles to negotiate, and the corridors are of sufficient dimension relative to the size of the vehicle to give the appearance that the vehicle is going faster than its actual speed as viewed by the displayed field of view of the camera of the vehicle negotiating the maze.

25. The entertainment attraction of claim 23, wherein the environment is disposed out of direct view of a plurality of game players located at the plurality of driver consoles but in direct view of a plurality of spectators watching the plurality of vehicles traversing the environment.

* * * * *